US009275806B2

(12) United States Patent
Stifter, Jr. et al.

(10) Patent No.: US 9,275,806 B2
(45) Date of Patent: Mar. 1, 2016

(54) ELECTRICAL SWITCHING APPARATUS, AND TRIP ASSEMBLY AND LEVER MEMBER THEREFOR

(71) Applicant: EATON CORPORATION, Cleveland, OH (US)

(72) Inventors: Frank Joseph Stifter, Jr., Coraopolis, PA (US); William John Jones, Cranberry Township, PA (US); Brian Scott Jansto, Beaver Falls, PA (US); Thomas Mark Whalen, Cranberry Township, PA (US)

(73) Assignee: EATON CORPORATION, Cleveland, OH (US)

( * ) Notice: Subject to any disclaimer, the term of this patent is extended or adjusted under 35 U.S.C. 154(b) by 29 days.

(21) Appl. No.: 14/310,124

(22) Filed: Jun. 20, 2014

(65) Prior Publication Data

US 2015/0371791 A1 Dec. 24, 2015

(51) Int. Cl.
*H01H 3/04* (2006.01)

(52) U.S. Cl.
CPC ..... *H01H 3/04* (2013.01)

(58) Field of Classification Search
CPC .. H01H 71/1054; H01H 71/2463; H01H 3/60
USPC ..... 200/335, 330, 332; 335/21, 46, 157, 335/176, 167, 168, 172
See application file for complete search history.

(56) References Cited

U.S. PATENT DOCUMENTS

| | | | | |
|---|---|---|---|---|
| 4,521,757 | A * | 6/1985 | Hastings | H01H 51/12 335/126 |
| 6,486,758 | B1 | 11/2002 | Olszewski et al. | |
| 6,545,584 | B2 | 4/2003 | Turner | |
| 6,850,135 | B1 * | 2/2005 | Puskar | H01H 71/1009 335/166 |
| 7,064,634 | B1 | 6/2006 | Wehrli, III et al. | |
| 2005/0024173 | A1 | 2/2005 | Puskar et al. | |
| 2014/0375400 | A1 | 12/2014 | Bertrand | |

FOREIGN PATENT DOCUMENTS

| | | |
|---|---|---|
| EP | 2 816 582 A1 | 12/2014 |
| GB | 1 542 542 A | 3/1979 |

OTHER PUBLICATIONS

European Patent Office, "International Search Report and Written Opinion for PCT/US2015/027700", Jul. 17, 2015, 12 pp.

* cited by examiner

*Primary Examiner* — Vanessa Girardi
(74) *Attorney, Agent, or Firm* — Eckert Seamans Cherin & Mellott, LLC; John P. Powers; Grant E. Coffield

(57) ABSTRACT

A lever member is for a trip assembly of an electrical switching apparatus. The electrical switching apparatus includes a housing, a signaling mechanism, separable contacts, and an operating mechanism structured to open and close the separable contacts. The trip assembly includes a mounting assembly disposed on the housing and a drive assembly. The drive assembly includes an actuator coupled to the mounting assembly and a plunger disposed on the mounting assembly and being cooperable with the operating mechanism. The lever member includes: a pivot portion structured to engage the mounting assembly; a first arm portion structured to engage the plunger; and a second arm portion disposed between the pivot portion and the first arm portion, the second arm portion being structured to engage the actuator.

20 Claims, 7 Drawing Sheets

ELECTRICAL SWITCHING APPARATUS, AND TRIP ASSEMBLY AND LEVER MEMBER THEREFOR

This invention was made with Government support under Contract N65540-11-C-0024 awarded by the United States Navy. The Government has certain rights in this invention.

BACKGROUND

1. Field

The disclosed concept pertains generally to electrical switching apparatus such as for example, circuit breakers. The disclosed concept also pertains to trip assemblies for electrical switching apparatus. The disclosed concept further relates to lever members for trip assemblies.

2. Background Information

In certain applications, such as, for example and without limitation, naval applications (e.g., without limitation, water-based vehicles, such as ships, boats, aircraft carriers, other vessels for travel on water, and submarines, or other vehicles for travel under water), electrical equipment must be designed to withstand large shock loads (e.g., up to about 1000 times the force of gravity, or more). Such shock loads include, for example, impact loads resulting from a direct hit by a torpedo, depth charge, missile, other ammunition or impact force, as well as residual or aftershock loads caused, for example, by a nearby indirect explosion, such as the detonation of a depth charge. All shock loads can severely damage the electrical equipment. Accordingly, electrical components for such applications must be designed to withstand much larger loads than typically experienced by electrical equipment employed in conventional civilian or commercial applications.

There is thus room for improvement in electrical switching apparatus, and in trip assemblies and lever members therefor.

SUMMARY

These needs and others are met by embodiments of the disclosed concept wherein a lever member is provided which among other benefits, enables a trip assembly of an electrical switching apparatus to trip open a pair of separable contacts.

In accordance with one aspect of the disclosed concept, a lever member for a trip assembly of an electrical switching apparatus is provided. The electrical switching apparatus comprises a housing, a signaling mechanism, separable contacts, and an operating mechanism structured to open and close the separable contacts. The trip assembly comprises a mounting assembly disposed on the housing and a drive assembly. The drive assembly comprises an actuator coupled to the mounting assembly and a plunger disposed on the mounting assembly and being cooperable with the operating mechanism. The lever member comprises: a pivot portion structured to engage the mounting assembly; a first arm portion structured to engage the plunger; and a second arm portion disposed between the pivot portion and the first arm portion, the second arm portion being structured to engage the actuator.

As another aspect of the disclosed concept, a trip assembly for an electrical switching apparatus is provided. The electrical switching apparatus comprises a housing, a signaling mechanism, separable contacts, and an operating mechanism structured to open and close the separable contacts. The trip assembly comprises: a mounting assembly structured to be disposed on the housing; and a drive assembly coupled to the mounting assembly, the drive assembly comprising: an actuator structured to be cooperable with the signaling mechanism, a plunger structured to be cooperable with the operating mechanism, and a lever member structured to engage each of the actuator and the plunger.

As a further aspect of the disclosed concept, an electrical switching apparatus comprises: a housing; a signaling mechanism; separable contacts; an operating mechanism structured to open and close the separable contacts; and a trip assembly comprising: a mounting assembly disposed on the housing; and a drive assembly coupled to the mounting assembly, the drive assembly comprising: an actuator cooperable with the signaling mechanism; a plunger cooperable with the operating mechanism; and a lever member structured to engage each of the actuator and the plunger.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts touch and/or exert a force against one another either directly or through one or more intermediate parts or components.

As employed herein, the term "fastener" refers to any suitable connecting or tightening mechanism expressly including, but not limited to, rivets, screws, bolts and the combinations of bolts and nuts (e.g., without limitation, lock nuts) and bolts, washers and nuts.

Figure 1:
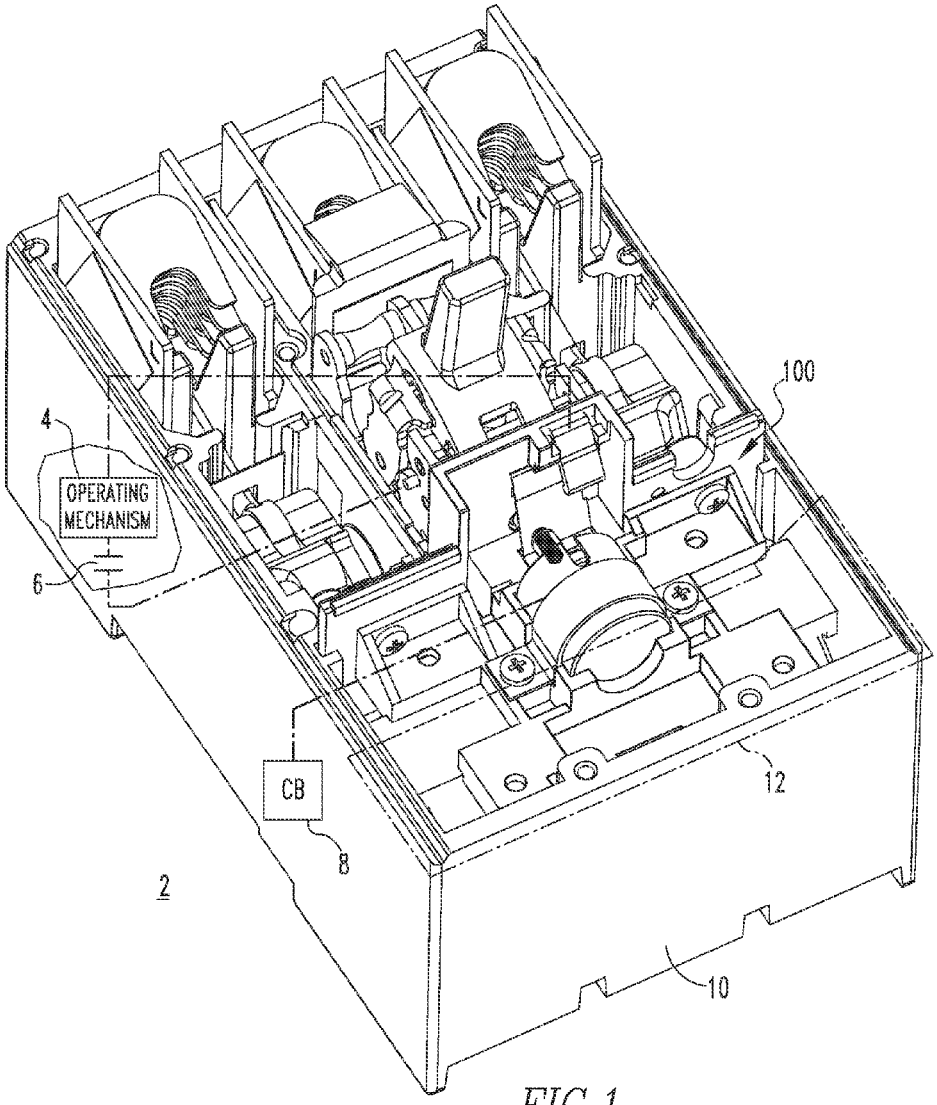
FIG. 1 is an isometric view of a portion of an electrical switching apparatus, in accordance with an embodiment of the disclosed concept.

FIG. 1 shows a portion of an electrical switching apparatus (e.g., without limitation, circuit breaker 2) in accordance with a non-limiting embodiment of the disclosed concept. The circuit breaker 2 is preferably an automatic quenched break circuit breaker or a non-automatic quenched break circuit breaker. In the example of FIG. 1, the circuit breaker 2 includes an operating mechanism 4 (shown in simplified form) and a pair of separable contacts 6 (shown in simplified form). The circuit breaker 2 further includes a signaling mechanism (e.g., without limitation, circuit board 8 (shown in simplified form)) and a trip assembly 100 cooperable with the circuit board 8. In operation, in response to a mechanical shock event, such as, for example and without limitation, shock or vibration caused by a direct hit by a torpedo, depth charge, missile, or other ammunition or impact force on a naval vessel (not shown), the operating mechanism 4 is designed to keep the separable contacts 6 closed and advantageously protect the circuit breaker 2 from such mechanical impact loads. As will be discussed in greater detail hereinbelow, in response to a tripping condition (e.g., without limitation, an overcurrent condition), the circuit board 8 is structured to send a signal to the trip assembly 100, which cooperates with the operating mechanism 4 to trip open the separable contacts 6. Additionally, as seen, the circuit breaker 2 has a housing 10 that includes a cover portion 12 (partially shown in phantom line drawing). The cover portion 12 advantageously retains the trip assembly 100 within the housing 10 of the circuit breaker 2, without requiring an additional separate fastening mechanism, means or method.

Figure 2A:
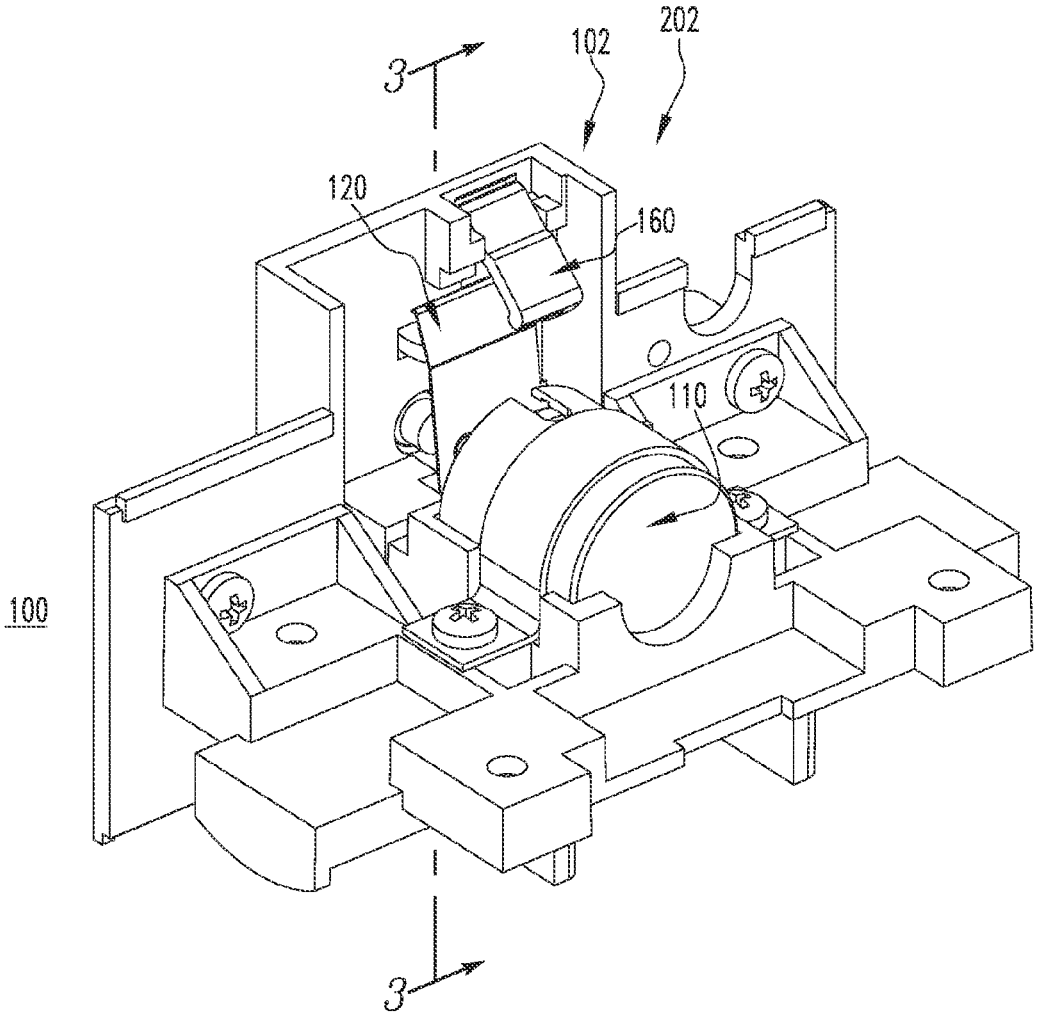
FIG. 2A is an isometric view of a trip assembly for the electrical switching apparatus of FIG. 1.
Figure 2B:
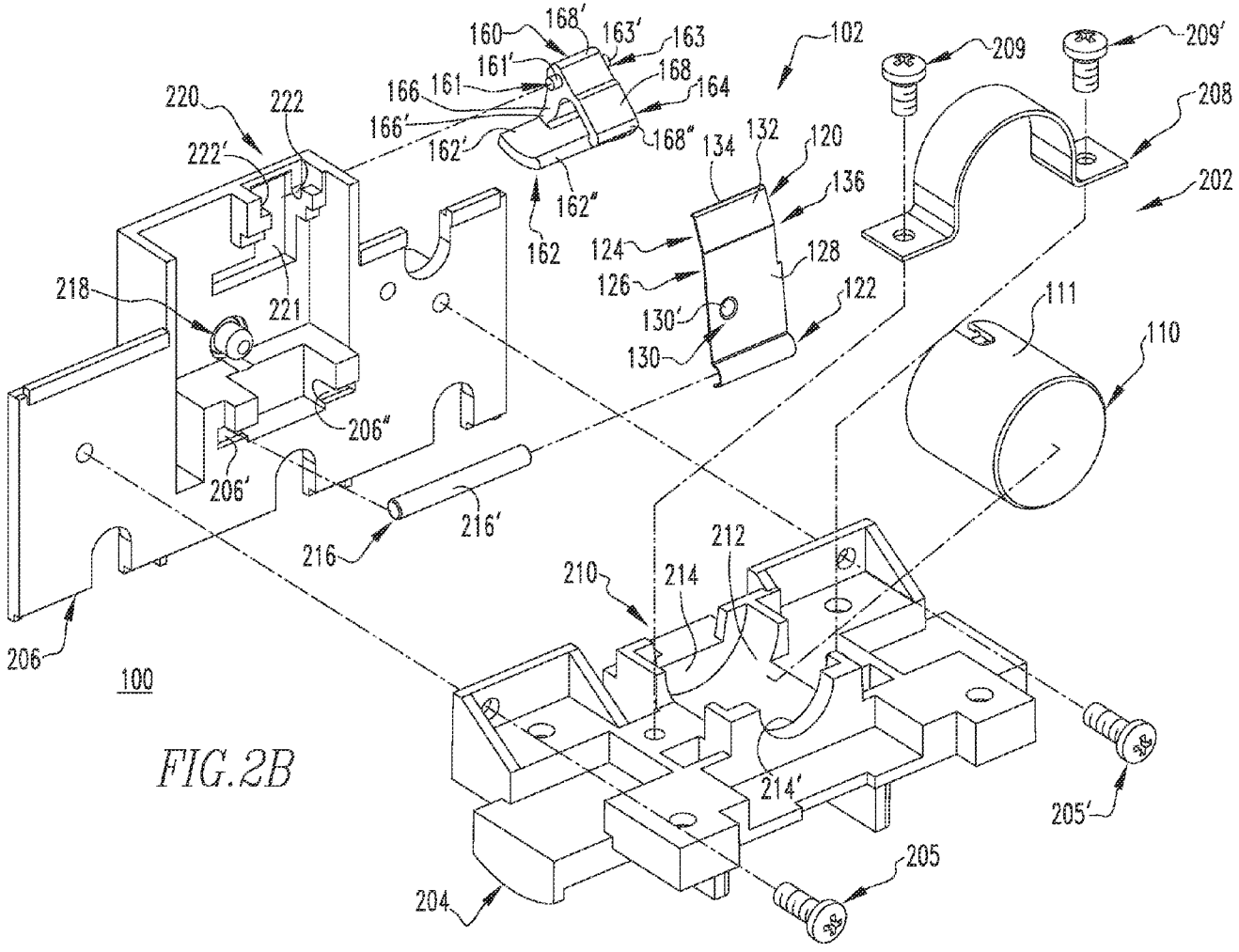
FIG. 2B is an exploded isometric view of the trip assembly of FIG. 2A.

Referring to FIG. 2A and FIG. 2B, the trip assembly 100 includes a mounting assembly 202 and a drive assembly 102 coupled to the mounting assembly 202. The drive assembly 102 and the mounting assembly 202 are each structured to be located within the housing 10 (FIG. 1) of the circuit breaker 2 (FIG. 1). The drive assembly 102 includes an actuator 110, a lever member 120, and a plunger 160. In operation, the actuator 110 is structured to drive the lever member 120 into the plunger 160, which cooperates with the operating mechanism 4 (FIG. 1) to advantageously cause the separable contacts 6 (FIG. 1) to trip open. More specifically, the plunger engages the operating mechanism 4, causing the separable contacts 6 to part, thus breaking the circuit.

As seen in FIG. 2B, the mounting assembly 202 includes a first frame member 204, a second frame member 206, and a number of fasteners 205,205' for coupling the first frame member 204 to the second frame member 206. Additionally, the first frame member 204 has a receiving portion 210 for receiving the actuator 110, and the mounting assembly 202 includes a strap member 208 and another number of fasteners 209,209'. The receiving portion 210 generally includes a partially cylindrical-shaped surface 212 and a pair of opposing generally parallel side surfaces 214,214' between which the actuator 110 is structured to be located. As seen, the actuator 110 includes a cylindrical-shaped outer surface 111 shaped substantially similarly to the partially cylindrical shaped surface 212 of the receiving portion 210, advantageously allowing for a secure connection between the actuator 110 and the partially cylindrical-shaped surface 212 of the first frame member 204. Furthermore, the fasteners 209,209' couple the strap member 208, which is located around the actuator 110, to the first frame member 204. Thus, by employing the strap member 208, the actuator 110 is advantageously well retained on and coupled to the mounting assembly 202.

Additionally, although the disclosed concept has been described in association with the actuator 110 being coupled to the first frame member 204 by employing the strap member 208, it is within the scope of the disclosed concept for the actuator 110 or a suitable alternative actuator (not shown) to be retained on the first frame member 204 or a suitable alternative frame member (not shown) by any known or suitable alternative retention mechanism, method, or means (not shown). For example and without limitation, the actuator 110 may be press fit into the receiving portion 210 of the first frame member 204. Furthermore, frame members (not shown) and actuators (not shown) may have alternative shapes and/or configurations, without departing from the scope of the disclosed concept. For example and without limitation, a frame member (not shown), may have a rectangular-shaped receiving portion to receive an actuator (not shown) that has planar surfaces rather than the cylindrical shape shown and described herein.

Continuing to refer to FIG. 2B, the lever member 120 includes a pivot portion (e.g., without limitation, elongated hook 122), a first arm portion 124, and a second arm portion 126 located between the elongated hook 122 and the first arm portion 124. The first arm portion 124 is structured to engage the plunger 160 and the second arm portion 126 is structured to engage the actuator 110. Additionally, the mounting assembly 202 includes a pin member 216 that has a cylindrical-shaped outer surface 216'. The second frame member 206 has a number of slots (e.g., without limitation, slots 206', 206"). The pin member 216 is structured to be located in the slots 206', 206". Of course, it will be appreciated that a frame member (not shown) may have any known or suitable alternative shape and/or configuration to receive the pin member 216. In operation, and as will be discussed below, the elongated hook 122 is structured to engage and rotate with respect to the outer surface 216' of the pin member 216.

Furthermore, the second frame member 206 includes a receiving portion 220 for receiving the plunger 160. The receiving portion 220 includes a pair of opposing and spaced apart partially cylindrical-shaped surfaces 222,222', and an L-shaped opening 221, as shown. The plunger 160 generally includes an elongated member 162 and a generally V-shaped member 164 connected to the elongated member 162. Furthermore, the plunger 160 has a number of cylindrical-shaped protrusions 161,163 extending outwardly from and generally normal with respect to the V-shaped member 164. The protrusions 161,163 include cylindrical-shaped outer surfaces 161',163' that are shaped substantially similarly to the surfaces 222,222' of the second frame member 206, advantageously allowing the plunger 160 to pivot about the surfaces 222,222' and rotate through the L-shaped opening 221 during the tripping operation.

The generally V-shaped member 164 has a pair of walls 166,168, and an opening between the walls 166,168. The elongated member 162 includes a pair of spaced apart and parallel side portions 162',162". The first wall 166 includes a first end portion 166' connected to the side portion 162'. Furthermore, the second wall 168 includes a first end portion 168' connected to the first wall 166 and a second end portion 168" spaced apart from the first wall 166. Additionally, the side portion 162" is generally located between the end portion 166' of the first wall 166 and the second end portion 168" of the second wall 168.

Figure 5:
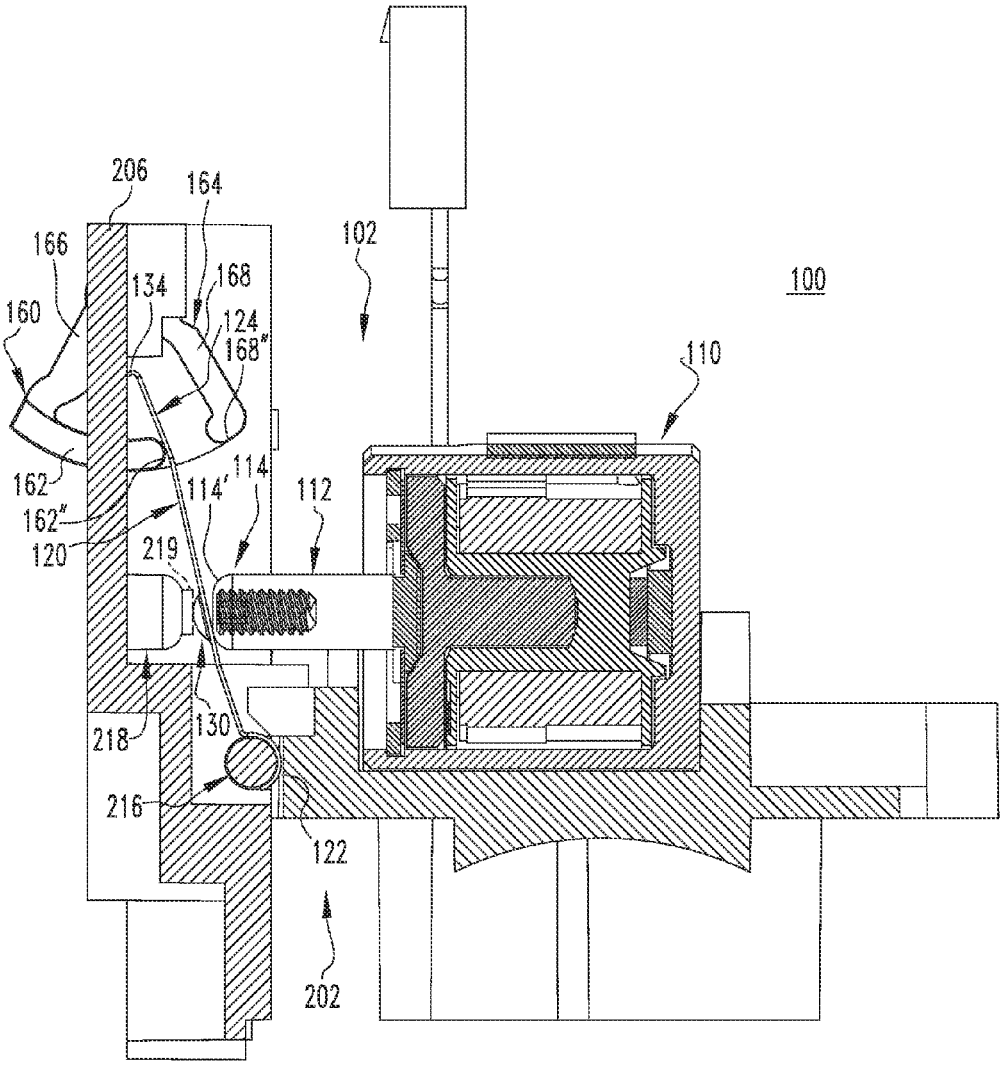
FIG. 5 is a section view of the trip assembly, taken along line 3-3 of FIG. 2A, shown with the drive assembly in the unloaded position.

In operation, the structure of the plunger 160 advantageously allows the lever member 120 to move between positions during the tripping operation. For example, the lever member 120 includes a cutout 136. During the tripping operation, and as will be discussed in greater detail hereinbelow, the drive assembly 102 is structured to move between a loaded position (FIG. 3) and an unloaded position (FIG. 5). As the drive assembly 102 moves between the loaded position (FIG. 3) and the unloaded position (FIG. 5), the first wall 166 of the V-shaped member 164 extends into the cutout 136, thereby allowing the lever member 120 to freely rotate with respect to the pin member 216.

Although the disclosed concept has been described in association with the plunger 160 and the receiving portion 220 of the second frame member 206, it will be appreciated that any known or suitable alternative shape and/or configuration (not shown) of such components, may be employed to perform the desired function of allowing the actuator 110 and the lever member 120 to cause the operating mechanism 4 (FIG. 1) to open and close the separable contacts 6 (FIG. 1). For example and without limitation, it is within the scope of the disclosed concept for a plunger (not shown) shaped similar to the plunger 160 to not include the protrusions 161,163, but rather have a cylindrical-shaped through hole, and employ a fixed pin (not shown) located on the second frame member 206 extending across the receiving portion 220 and through the cylindrical-shaped through hole, thus allowing such a plunger (not shown) to freely rotate.

Figure 3:
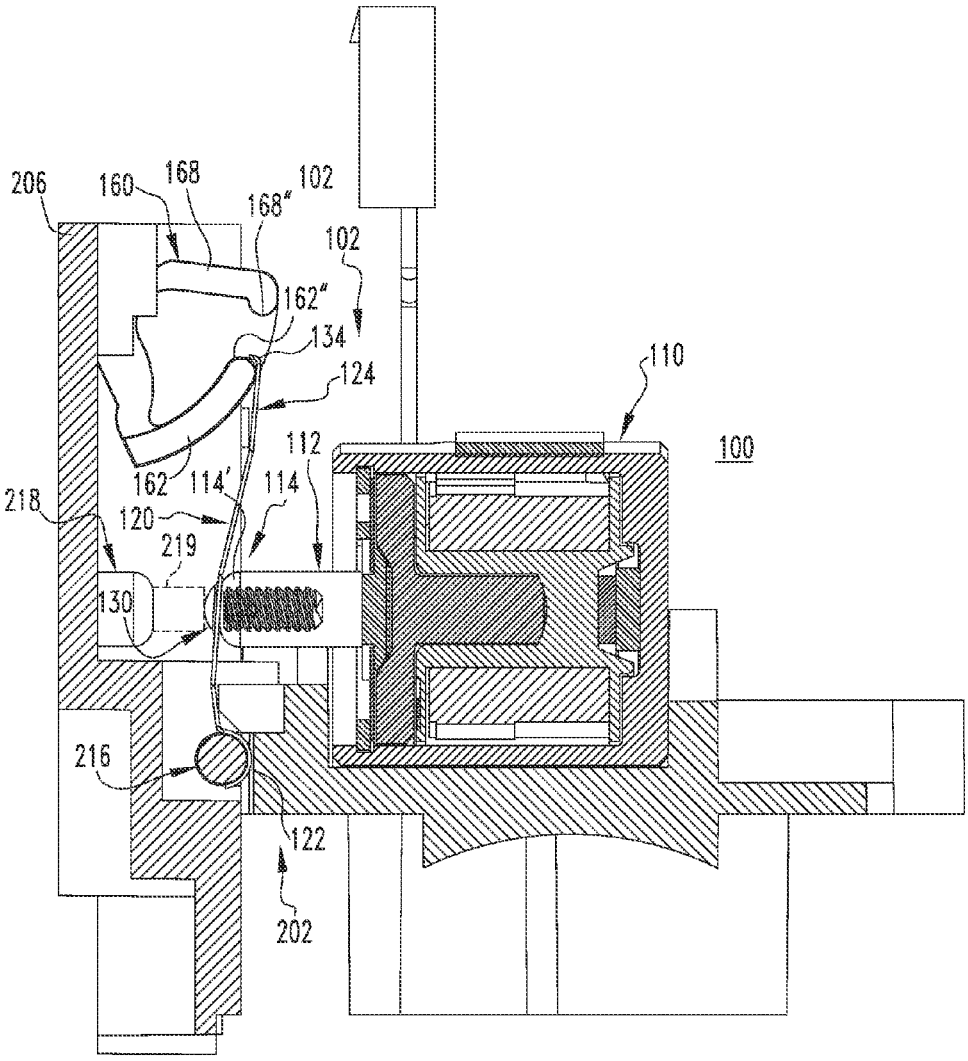
FIG. 3 is a section view of the trip assembly, taken along line 3-3 of FIG. 2A, shown with the drive assembly in the loaded position.

FIG. 3 shows a section view of the trip assembly 100 in the loaded position, corresponding to the actuator 110 being reset and the separable contacts 6 (FIG. 1) being closed. Because the circuit breaker 2 includes circuitry (not shown) located directly adjacent the plunger 160, the actuator 110 must be placed lower in the circuit breaker 2 (FIG. 1). Thus, by employing the lever member 120, the actuator 110 is advantageously able to be offset from the plunger 160.

Figure 4:
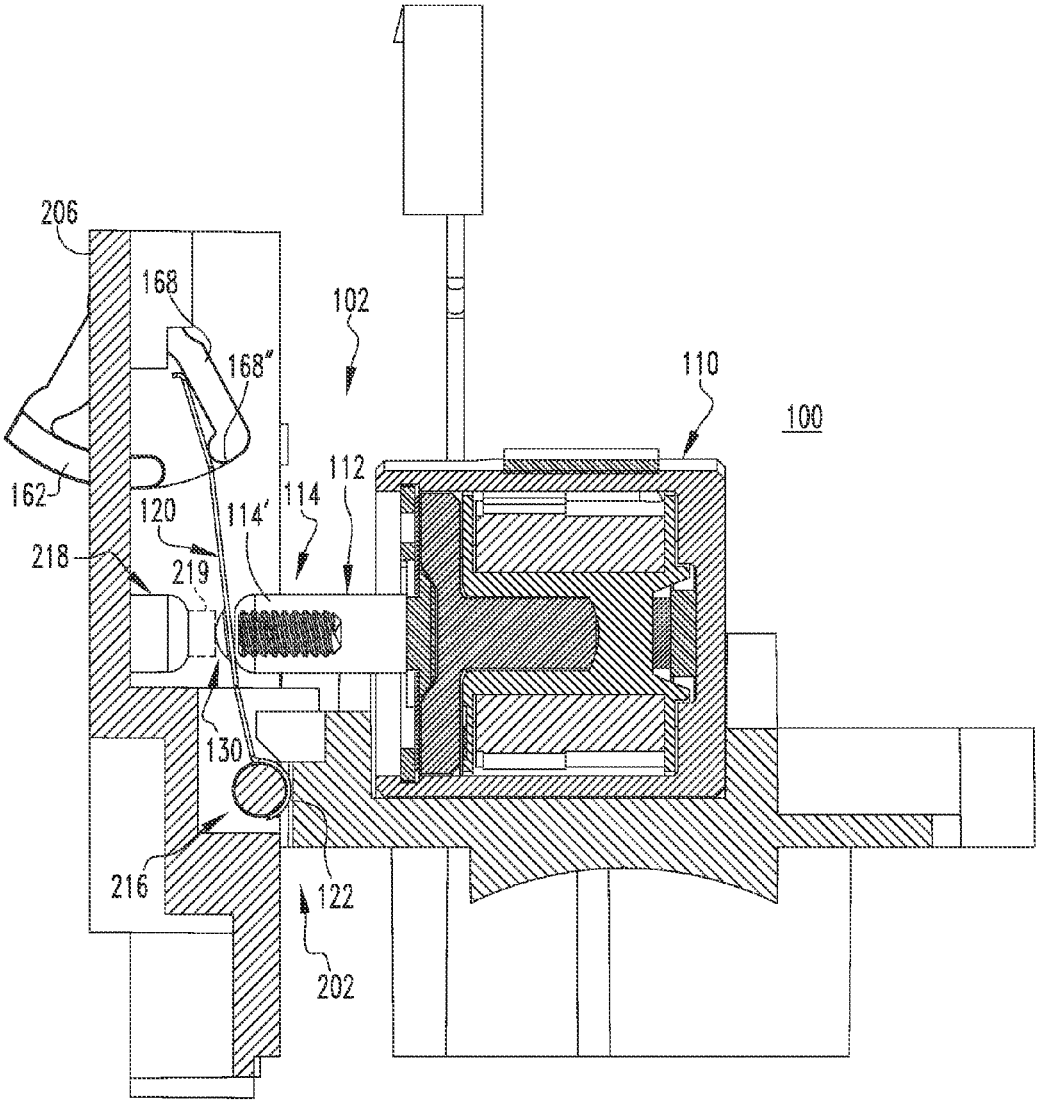
FIG. 4 is a section view of the trip assembly, taken along line 3-3 of FIG. 2A, shown with the drive assembly partially unloaded.

Moreover, the actuator 110 includes a spring-loaded elongated member 112 that includes an end portion 114 having a rounded end surface 114'. As the drive assembly 102 moves from the loaded position to the unloaded position (FIG. 5), the actuator 110 moves from the reset position to an extended position (FIG. 5) and the elongated member 112 thus drives the lever member 120 into the plunger 160 to trip open the separable contacts 6 (FIG. 1). Additionally, as the drive assembly 102 moves from the unloaded position to the loaded position, the plunger 160 drives the lever member 120 into the elongated member 112 to reset the actuator 110 and allow for closing of the separable contacts 6 (FIG. 1). FIG. 4 shows a section view of the trip assembly 100 in which the elongated member 112 is partially extended. In this position, the actuator 110 is between the reset position (FIG. 3) and the extended position (FIG. 5).

Figure 9:
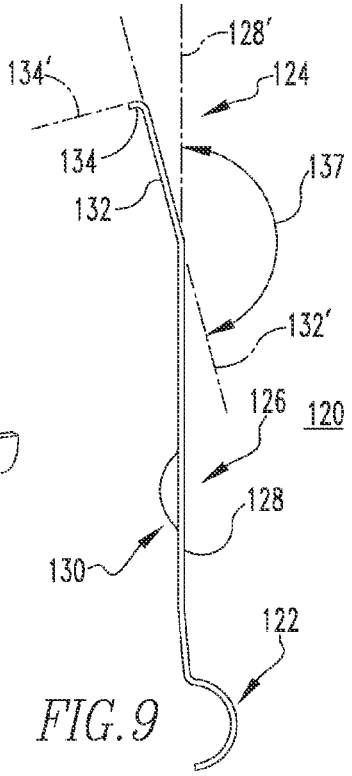
FIG. 9 is an elevation view of the lever member of FIGS. 6-8.

FIGS. 6 through 9 show different views of the lever member 120. As seen in FIG. 9, the first arm portion 124 includes a planar portion 132 and a latching portion 134 that extends from and is bent with respect to the planar portion 132. The planar portion 132 is located in a plane 132' and the latching portion 134 is located in a plane 134' generally normal to the plane 132'. However, it will be appreciated that the lever member 120 may have any known or suitable alternative size, shape, or configuration (not shown), without departing from the scope of the disclosed concept. For example and without limitation, it is within the scope of the disclosed concept for a latching portion (not shown) of a lever member (not shown) to be at an acute angle with respect to a corresponding planar portion (not shown).

Referring again to FIG. 3, the lever member 120 extends into an opening between the side portion 162" of the elongated member 162 and the second end portion 168" of the second wall 168 of the V-shaped member 164, which operate as receiving portions. The structure of the first arm portion 124 advantageously allows the lever member 120 to be retained on the plunger 160 when the actuator 110 is in the reset position. More specifically, the latching portion 134 advantageously allows the lever member 120 to be retained on the side portion 162" of the elongated member 162 when the actuator 110 is in the reset position. Thus, in the loaded position the latching portion 134 latches onto and engages the side portion 162" of the elongated member 162 and in the unloaded position (FIG. 5), the latching portion 134 substantially extends into the opening between the side portion 162" of the elongated member 162 and the second end portion 168" of the second wall 168 of the V-shaped member 164.

Referring again to FIGS. 6 through 9, the second arm portion 126 includes a planar portion 128 and a recessed portion 130 extending from the planar portion 128. As seen in FIG. 9, the planar portion 128 is generally located in a plane 128' that is at an angle 137 with respect to the planes 132'. The angle 137 is preferably between 180 degrees and 155 degrees. Thus, the planar portion 132 of the first arm portion 124 may be bent with respect to the second arm portion 126. Referring to FIGS. 3 through 5, it will be appreciated that as the actuator moves from the extended position (FIG. 5) to the reset position (FIG. 3), this feature increases the travel length of the lever member 120, advantageously ensuring that the lever member 120 reliably resets the actuator 110 to close the separable contacts 6 (FIG. 1). Of course, it is within scope of the disclosed concept for a lever member (not shown) to not have arm portions bent with respect to each other (e.g., without limitation, a single continuous planar arm portion extending from a pivot portion (not shown)).

Figure 6:
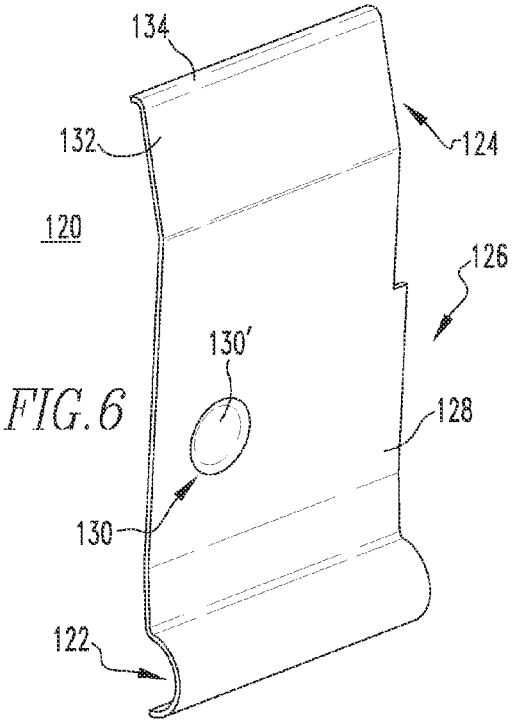
FIGS. 6-8 are isometric views of the lever member of the trip assembly of FIG. 5.
Figure 7:
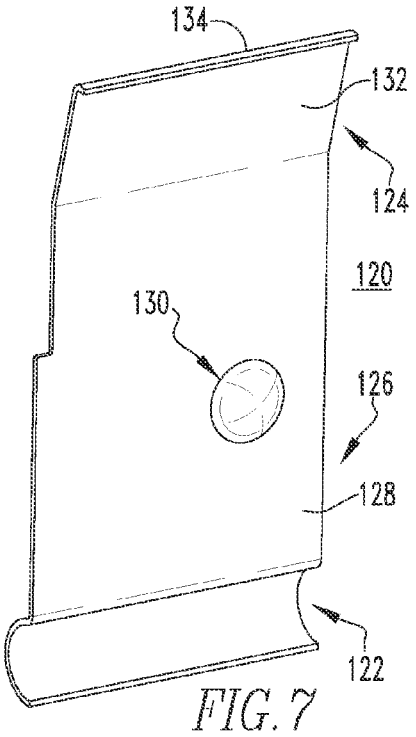
Figure 8:
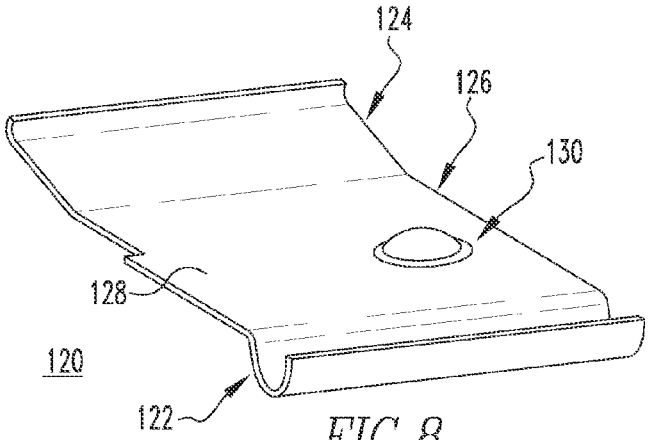

As seen in FIG. 6, the recessed portion 130 generally has a concave surface 130'. It will be appreciated that the concave surface 130' of the lever member 120 is shaped substantially similarly to and is structured to receive the rounded end surface 114' (FIGS. 3 through 5) of the actuator 110. In this manner, the elongated member 112 (FIGS. 3 through 5) will advantageously interact with and engage the lever member 120 at the same location (e.g., the concave surface 130') every time during the tripping operation. However, a lever member (not shown) and corresponding elongated member (not shown) of an actuator (not shown) may employ any known or suitable alternative shape and/or configuration of surfaces (not shown) which interact with each other, without departing from the scope of the disclosed concept. For example and without limitation, a lever member (not shown) may employ a planar surface to receive a corresponding planar end surface of an actuator (not shown).

Furthermore, and with reference to FIGS. 3 through 5, as the actuator moves between the reset and extended positions, the elongated hook 122 rotates with respect to the pin member 216. Thus, the lever member 120 allows the actuator 110 to drive the plunger 160, thereby forcing the operating mechanism 4 (FIG. 1) to advantageously trip open the separable contacts 6 (FIG. 1). Additionally, although the disclosed concept has been described in association with the elongated hook 122 rotating with respect to and engaging the pin member 216, it is within the scope of the disclosed concept for a lever member (not shown) to employ any known or suitable alternative shaped pivot portion (not shown) and/or for a mounting assembly (not shown) to employ any known or suitable mechanism, method, or means to enable the lever member (not shown) to perform the pivoting function.

Continuing to refer to FIGS. 3 through 5, the mounting assembly 202 further includes a barrier post 218 located on the second frame member 206 and a spring 219 (shown in simplified form) extending from the barrier post 218. As seen, the spring 219 engages the recessed portion 130 when the drive assembly 102 is in the loaded position (FIG. 3), the unloaded position (FIG. 5), and when the drive assembly is between positions (FIG. 4). In this manner, the spring 219 advantageously prevents the lever member 120 from vibrating during the tripping operation. Furthermore, when the drive assembly 102 is in the loaded position (FIG. 3), the spring 219 acts as a shock absorber, preventing the lever member 120 from moving the plunger 160 enough to undesirably open the separable contacts 6 (FIG. 1) during a mechanical shock event.

Accordingly, it will be appreciated that the disclosed concept provides for an improved (e.g., without limitation, resistant to mechanical shock, protected against impact loads) electrical switching apparatus (e.g., without limitation, circuit breaker 2, which may be an automatic quenched break circuit breaker or non-automatic quenched break circuit breaker), and trip assembly 100 and lever member 120 therefor, which among other benefits, provides a mechanism for tripping separable contacts 6 in response to a mechanical shock event (e.g., without limitation, shock or vibration caused by a direct hit by a torpedo, depth charge, missile, or other ammunition or impact force on a naval vessel), and resetting the separable contacts 6.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A trip assembly for an electrical switching apparatus comprising a housing, a signaling mechanism, separable contacts, and an operating mechanism structured to open and close said separable contacts, said trip assembly comprising:

a mounting assembly structured to be disposed on said housing; and a drive assembly coupled to said mounting assembly, said drive assembly comprising:

an actuator structured to be cooperable with said signaling mechanism, a plunger structured to be cooperable with said operating mechanism, and a lever member structured to engage each of said actuator and said plunger, wherein said drive assembly is structured to move between a loaded position corresponding to said actuator being reset and an unloaded position corresponding to said actuator being extended, wherein as said drive assembly moves from said loaded position to said unloaded position, said actuator drives said lever member into said plunger, and wherein as said drive assembly moves from said loaded position to said unloaded position, said lever member causes said plunger to rotate without any intermediate components.

2. The trip assembly of claim 1 wherein said plunger has a first receiving portion, a second receiving portion, and an opening therebetween; wherein said lever member comprises an arm portion having a latching portion extending therefrom; wherein in said loaded position, said latching portion engages said first receiving portion; and wherein in said unloaded position, said latching portion substantially extends into said opening.

3. The trip assembly of claim 1 wherein said mounting assembly comprises a frame member, a strap member, and a number of fasteners; wherein said frame member has a receiving portion, said actuator being disposed in said receiving portion; wherein said strap member couples said actuator to said receiving portion; and wherein said number of fasteners couple said strap member to said frame member.

4. The trip assembly of claim 1 wherein said mounting assembly comprises a first frame member, a second frame member, and a number of fasteners coupling said second frame member to said first frame member, wherein said actuator is coupled to said first frame member; and wherein said plunger is disposed on said second frame member.

5. The trip assembly of claim 1 wherein, responsive to said drive assembly moving from said loaded position to said unloaded position, said lever member rotates in a first direction; and wherein, responsive to said drive assembly moving from said loaded position to said unloaded position, said plunger rotates in a second direction parallel to the first direction.

6. The trip assembly of claim 1 wherein said lever member comprises a pivot portion structured to engage said mounting assembly, a first arm portion structured to engage said plunger, and a second arm portion disposed between said pivot portion and said first arm portion, wherein said second arm portion is structured to engage said actuator, wherein said second arm portion has a planar portion and a recessed portion extending from said planar portion, and wherein said recessed portion is structured to receive a portion of said actuator.

7. The trip assembly of claim 6 wherein said first arm portion comprises a planar portion and a latching portion; wherein said latching portion is bent with respect to said planar portion of said first arm portion and extends therefrom; and wherein said planar portion of said first arm portion extends from said second arm portion and is bent with respect thereto.

8. The trip assembly of claim 7 wherein said pivot portion is an elongated hook; wherein said mounting assembly comprises a pin member; and wherein said elongated hook is structured to rotate with respect to said pin member.

9. The trip assembly of claim 1 wherein said lever member comprises a pivot portion engaging said mounting assembly, a first arm portion structured to engage said plunger, and a second arm portion disposed between said pivot portion and said first arm portion; and wherein said second arm portion is structured to engage said actuator.

10. The trip assembly of claim 9 wherein said second arm portion has a recessed portion having a concave surface; wherein said actuator comprises an elongated member having a rounded end portion; and wherein said rounded end portion has an end surface shaped substantially similarly to said concave surface.

11. The trip assembly of claim 9 wherein said mounting assembly comprises a pin member having a cylindrical shaped outer surface; wherein said pivot portion is an elongated hook substantially engaging said outer surface; and wherein as said drive assembly moves between said loaded and unloaded positions, said elongated hook rotates with respect to said pin member.

12. The trip assembly of claim 11 wherein said mounting assembly further comprises a frame member having a number of slots; and wherein said pin member is disposed in said number of slots.

13. An electrical switching apparatus comprising:

a housing;

a signaling mechanism;

separable contacts;

an operating mechanism structured to open and close said separable contacts; and a trip assembly comprising:

a mounting assembly disposed on said housing; and a drive assembly coupled to said mounting assembly, said drive assembly comprising:

an actuator cooperable with said signaling mechanism;

a plunger cooperable with said operating mechanism; and a lever member structured to engage each of said actuator and said plunger, wherein said drive assembly is structured to move between a loaded position corresponding to said actuator being reset and an unloaded position corresponding to said actuator being extended, wherein as said drive assembly moves from said loaded position to said unloaded position, said actuator drives said lever member into said plunger, and wherein as said drive assembly moves from said loaded position to said unloaded position, said lever member causes said plunger to rotate without any intermediate components.

14. The electrical switching apparatus of claim 13 wherein said housing comprises a cover portion for retaining said trip assembly within said housing.

15. The electrical switching apparatus of claim 13 wherein said electrical switching apparatus is selected from the group consisting of automatic quenched break circuit breaker and non-automatic quenched break circuit breaker.

16. The electrical switching apparatus of claim 13 wherein, responsive to said drive assembly moving from said loaded position to said unloaded position, said lever member rotates in a first direction; and wherein, responsive to said drive assembly moving from said loaded position to said unloaded position, said plunger rotates in a second direction parallel to the first direction.

17. The electrical switching apparatus of claim 13 wherein said signaling mechanism is a circuit board; and wherein said drive assembly moves from said loaded position to said unloaded position in response to a signal from said circuit board to said actuator.

18. The electrical switching apparatus of claim 17 wherein as said drive assembly moves from said loaded position to said unloaded position, said actuator drives said lever member into said plunger to trip open said separable contacts; wherein as said drive assembly moves from said unloaded position to said loaded position, said plunger drives said lever member into said actuator to reset said actuator; and wherein in said loaded position, said separable contacts are closed.

19. A trip assembly for an electrical switching apparatus comprising a housing, a signaling mechanism, separable contacts, and an operating mechanism structured to open and close said separable contacts, said trip assembly comprising:

a mounting assembly structured to be disposed on said housing; and a drive assembly coupled to said mounting assembly, said drive assembly comprising:

an actuator structured to be cooperable with said signaling mechanism, a plunger structured to be cooperable with said operating mechanism, and a lever member structured to engage each of said actuator and said plunger, wherein said drive assembly is structured to move between a loaded position corresponding to said actuator being reset and an unloaded position corresponding to said actuator being extended, wherein as said drive assembly moves from said loaded position to said unloaded position, said actuator drive said lever member into said plunger, wherein said mounting assembly comprises a frame member, a barrier post disposed on said frame member, and a spring extending from said barrier post; wherein said actuator comprises an elongated member; wherein said lever member comprises a recessed portion; and wherein in each of said loaded position and said unloaded position, said spring engages said recessed portion.

20. A trip assembly for an electrical switching apparatus comprising a housing, a signaling mechanism, separable contacts, and an operating mechanism structured to open and close said separable contacts, said trip assembly comprising:

a mounting assembly structured to be disposed on said housing; and a drive assembly coupled to said mounting assembly, said drive assembly comprising:

an actuator structured to be cooperable with said signaling mechanism, a plunger structured to be cooperable with said operating mechanism, and a lever member structured to engage each of said actuator and said plunger, wherein said drive assembly is structured to move between a loaded position corresponding to said actuator being reset and an unloaded position corresponding to said actuator being extended, wherein as said drive assembly moves from said loaded position to said unloaded position, said actuator drives said lever member into said plunger, wherein said plunger comprises an elongated member and a generally V-shaped member connected to said elongated member; wherein said generally V-shaped member has a first wall, a second wall, and an opening therebetween; wherein said elongated member comprises a first side portion and a second side portion spaced apart from and parallel with respect to said first side portion; wherein said first wall has a first end portion connected to said first side portion; wherein said second wall has a second end portion connected to said first wall and a third end portion spaced from said first wall; wherein said second side portion is disposed between said first end portion and said third end portion; wherein said lever member extends into said opening and includes a cutout; and wherein as said drive assembly moves from said loaded position to said unloaded position, said first wall extends into said cutout.

* * * * *